US007251449B2

(12) United States Patent
Bokelman et al.

(10) Patent No.: US 7,251,449 B2
(45) Date of Patent: Jul. 31, 2007

(54) ROTATING MEMBER

(75) Inventors: Kevin Bokelman, San Diego, CA (US); Allan Donley, San Diego, CA (US); Glenn W. Gaarder, Ramona, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 23 days.

(21) Appl. No.: 10/859,275

(22) Filed: Jun. 2, 2004

(65) Prior Publication Data

US 2005/0271435 A1 Dec. 8, 2005

(51) Int. Cl.
*G03G 15/00* (2006.01)

(52) U.S. Cl. ..... 399/367; 399/372; 399/17

(58) Field of Classification Search ..... 74/20, 74/337.5; 399/16, 17, 367, 372
See application file for complete search history.

(56) References Cited

U.S. PATENT DOCUMENTS 2,336,307 A * 12/1943 Slye ..... 464/57
2,871,702 A * 2/1959 Tetro ..... 74/1.5
3,385,119 A * 5/1968 Berger ..... 74/61
4,078,788 A 3/1978 Bellis et al.
5,445,371 A 8/1995 Marzullo et al.
6,082,912 A * 7/2000 Shimizu et al. ..... 400/120.01
6,260,840 B1 * 7/2001 Suga et al. ..... 271/10.12
6,592,117 B2 * 7/2003 Kuo et al. ..... 271/10.01
6,652,091 B2 11/2003 Tanno
6,948,871 B1 * 9/2005 Onishi et al. ..... 400/679

* cited by examiner

*Primary Examiner*—Ren Yan

(57) ABSTRACT

One embodiment of a mechanism may include a member having a first axis and a surface non-concentric with said first axis, a first gear rotatably mounted on said member at a second axis different from said first axis, and a device coupled to either of said member or said first gear to rotate said member when said first gear rotates about said second axis.

15 Claims, 4 Drawing Sheets

Fig. 1
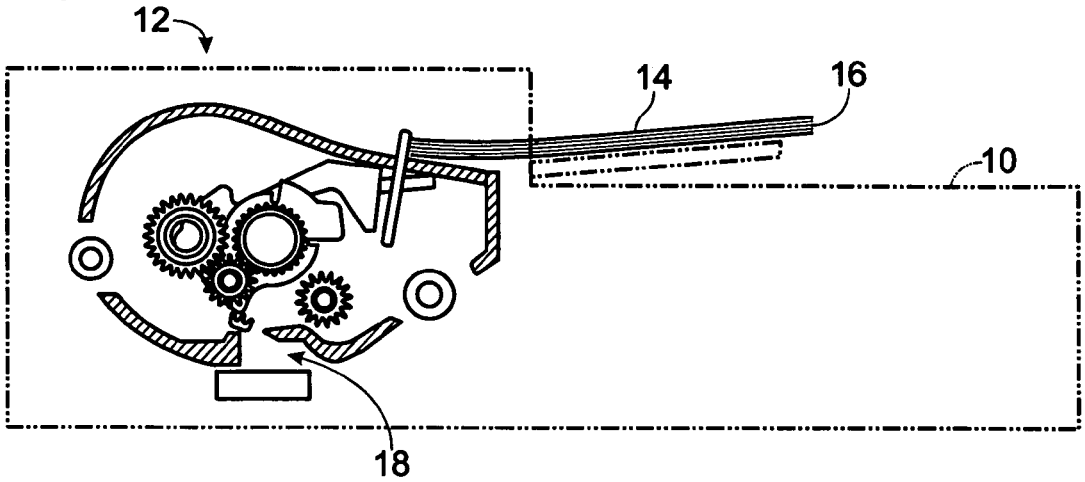
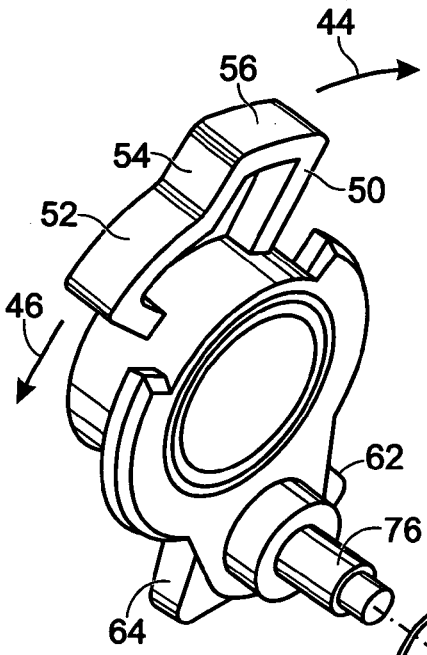
Fig. 3
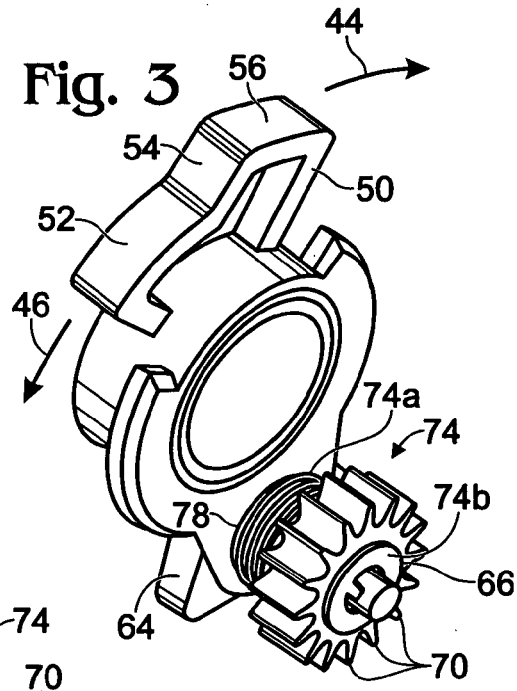
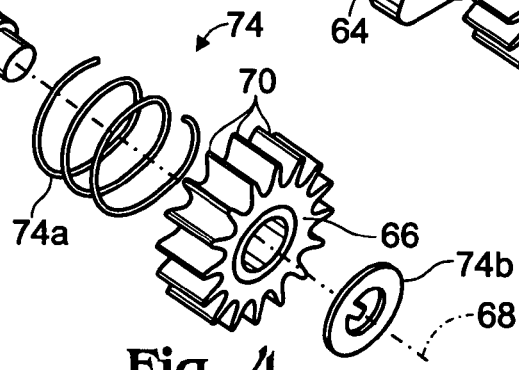
Fig. 4

ROTATING MEMBER

BACKGROUND

Imaging devices, for example, printers, copiers, scanners and facsimile machines, may include a drive assembly that may drive one or more rollers, and/or other mechanisms, to advance sheets of media through the device. The drive assembly may include a controller, a motor, a transmission, one or more drive shafts, and one or more drive rollers mounted on the drive shaft(s).

BRIEF DESCRIPTION OF THE DRAWINGS

FIG. 1 is a side cross-sectional view of one embodiment of an imaging device including one embodiment of a rotating member.

FIGS. 3 and 4 are a perspective view and an exploded view, respectively, of one embodiment of a rotating member.

DETAILED DESCRIPTION OF THE DRAWINGS

FIG. 1 is a side cross-sectional schematic view of one embodiment of an imaging system 10. Imaging system 10 may comprise, for example, a printer, a copier, a scanner and/or a facsimile machine, or any combination thereof. Imaging system 10 may include an automatic document feeder (ADF) 12 that may allow positioning of an original sheet 14 of media therein, and/or a stack 16 of media therein, for feeding to an imaging zone 18 within system 10. In one embodiment, sheet 14 may comprise a single sheet of paper. However, any type of media material may be utilized, such as cardboard, fabric, mylar, transparency, photographic paper, or the like.

Figure 2:
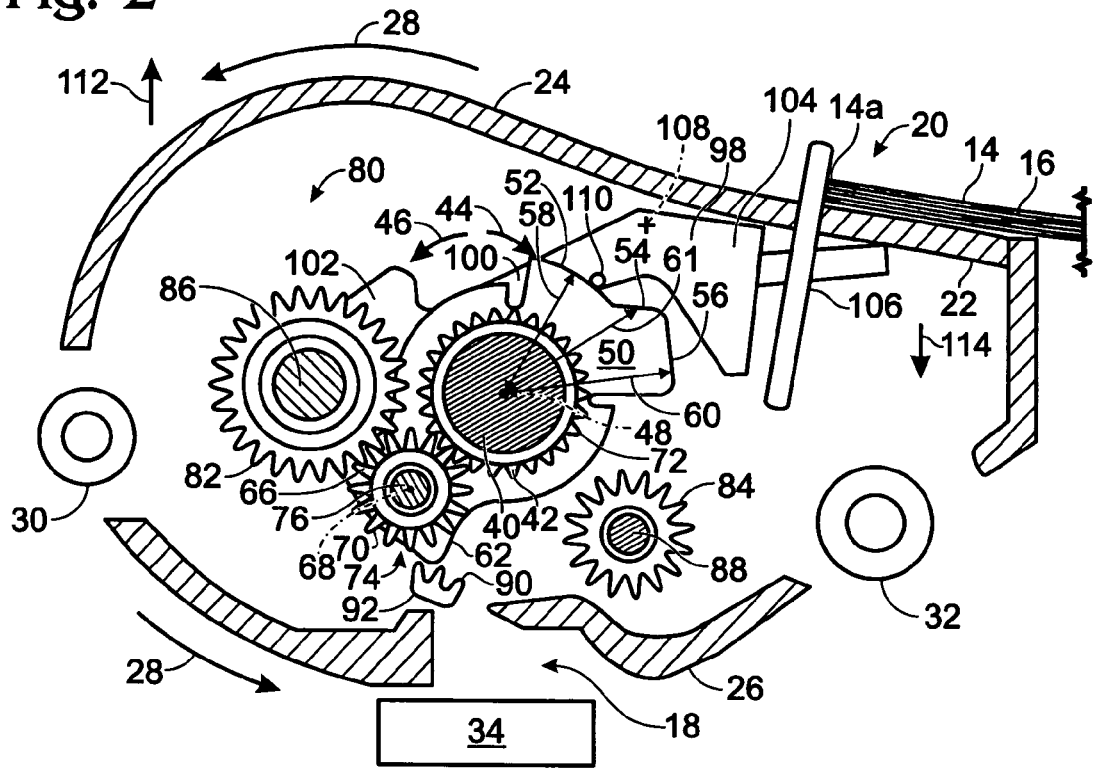
FIG. 2 is a side cross-sectional view of one embodiment of a rotating member in a scan mode.

FIG. 2 is side cross-sectional view of one embodiment of imaging system 10 in a scan mode, i.e., in a mode where sheet 14 may be moved around chassis 22 and past an imaging device 34 for imaging thereon or thereof. A mechanism 20 may be positioned within a chassis 22 including an upper chassis 24 and a lower chassis 26 that together define a path 28 including imaging zone 18. Mechanism 20 may move between the scan mode (see FIG. 2) and a pick mode (see FIG. 7), i.e., a mode wherein a sheet 14 may be picked from stack 16 for movement around chassis 22, and a gate actuation mode (see FIG. 6), i.e., a mode where a gate 106 may be lowered to allow picking of a sheet 14 from stack 16. In the embodiment shown, path 28 may comprise a 180° curvature such that a direction of sheet 14 is changed as the sheet is moved around chassis 22. Path 28 may include drive rollers 30 and 32 for moving sheet 14 and an imaging device 34 such as an inkjet printhead, a scanning device, or the like.

Mechanism 20 may include a driveshaft 40 having a drive gear 42 mounted thereon. Drive gear 42 may be fixedly secured to driveshaft 40 such that rotation of driveshaft 40 in either of first or second directions 44 and 46, respectively, will cause corresponding rotation of drive gear 42 in first or second direction 44 or 46, respectively. In one embodiment, first rotational direction 44 may comprise clockwise rotation of driveshaft 40 and drive gear 42 about a driveshaft axis 48, and second rotational direction 46 may comprise counter-clockwise rotation of driveshaft 40 and drive gear 42 about driveshaft axis 48.

Mechanism 20 may further include a member 50, which in one embodiment may comprise a collar, mounted on driveshaft 40 for rotational movement about driveshaft axis 48. In other embodiments, member 50 may pivot, swing, toggle or otherwise move on driveshaft axis 48. Member 50 may not be fixedly secured to driveshaft 40 such that the member may freely rotate about driveshaft 40. Member 50 may include a first cam surface 52, a second cam surface 54 and a third cam surface 56. First and third cam surfaces 52 and 56 may be concentric with driveshaft axis 48 wherein first cam surface 52 may be positioned at a first radial distance 58 from driveshaft axis 48, wherein third cam surface 56 may be positioned at a second radial distance 60 from driveshaft axis 48, and wherein radial distance 60 may be greater than radial distance 58. Second cam surface 54 may be non-concentric to driveshaft axis 48 and may be referred to as a transition or an actuation surface of member 50 that extends between first and third cam surfaces 52 and 56. In other words, second cam surface 54 may define a transitional radial distance 61 that changes, i.e., increases from first radial distance 58 to second radial distance 60. Member 50 may further include first and second anti-rotation stop surfaces 62 and 64 (see FIG. 6) that prevent member 50 from over rotating on driveshaft 40, as will be discussed in more detail below.

Mechanism 20 may further include a gear 66 rotatably mounted on member 50 between stop surfaces 62 and 64. Gear 66 may be rotatably mounted on member 50 at a gear axis 68 that is parallel to but not contiguous with driveshaft axis 48. Accordingly, gear 66 may rotate on member 50 about gear axis 68 and may precess about driveshaft axis 48 as member 50 rotates about driveshaft axis 48. In the embodiment shown, gear 66 may be smaller in diameter than other gears of mechanism 20, discussed in further detail below, such that gear 66 may be referred to as a pinion gear.

Gear 66 may be sized and positioned on member 50 such that the teeth 70 of gear 66 may mateably engage and be driven by the teeth 72 of drive gear 42. Accordingly, in one embodiment, rotation of drive gear 42 in first direction 44 will cause rotation of gear 66 in second direction 46 and rotation of drive gear 42 in second direction 46 will cause rotation of gear 66 in first direction 44.

Referring to FIGS. 3 and 4, mechanism 20 may further include a connection or a drag device 74 operatively connected to gear 66 or to member 50 such that rotation of gear 66 about gear axis 68 will cause an opposite rotation of member 50 about driveshaft axis 48. In one embodiment, device 74 may comprise a spring **74*a* and a press clip 74*b* secured about a gear shaft 76 wherein gear 66 is spring loaded by a spring 74*a* against press clip 74*b* which frictionally engages member 50. Accordingly, in one embodiment, rotation of gear 66 in first direction 44 will cause rotation of member 50 in second direction 46 and rotation of gear 66 in second direction 46 will cause rotation of member 50 in first direction 44**.

Referring again to FIG. 2, mechanism 20 may further include a gear train assembly 80 drivingly engaged to drive rollers 30 and 32. Gear train assembly 80 may include a first gear 82 connected to drive rollers 30 and 32 through an even number of gears (not all gears shown for ease of illustration), and a second gear 84 connected to drive rollers 30 and 32 through an odd number of gears (not all gears shown for ease of illustration). Accordingly, rotation of first gear 82 in one direction and rotation of second gear 84 in an opposite direction will both result in drive rollers 30 and 32 both being rotated in the same direction, such as to drive a sheet 14 in the forward drive direction along path 28.

In the embodiment shown, first gear 82 may be positioned to mateably engage gear 66 when member 50 rotates in first direction 44 and second gear 84 may be positioned to mateably engage gear 66 (see FIG. 7) when member 50 rotates in second direction 46 about driveshaft axis 48. When driveshaft 40 rotates in first direction 44, drive gear 42 may also rotate in first direction 44, which may rotate gear 66 in second direction 46, which may rotate member 50 in first direction 44. Rotation of member 50 in first direction 44 may move gear 66 into engagement with first gear 82 and may cause rotation of first gear 82 in first direction 44. Stop surface 64 (see FIG. 5) on member 50 may contact a shaft 86 of first gear 82 and thereby may prevent over rotation of member 50, such that gear 66 may not overly engage first gear 82.

Figure 5:
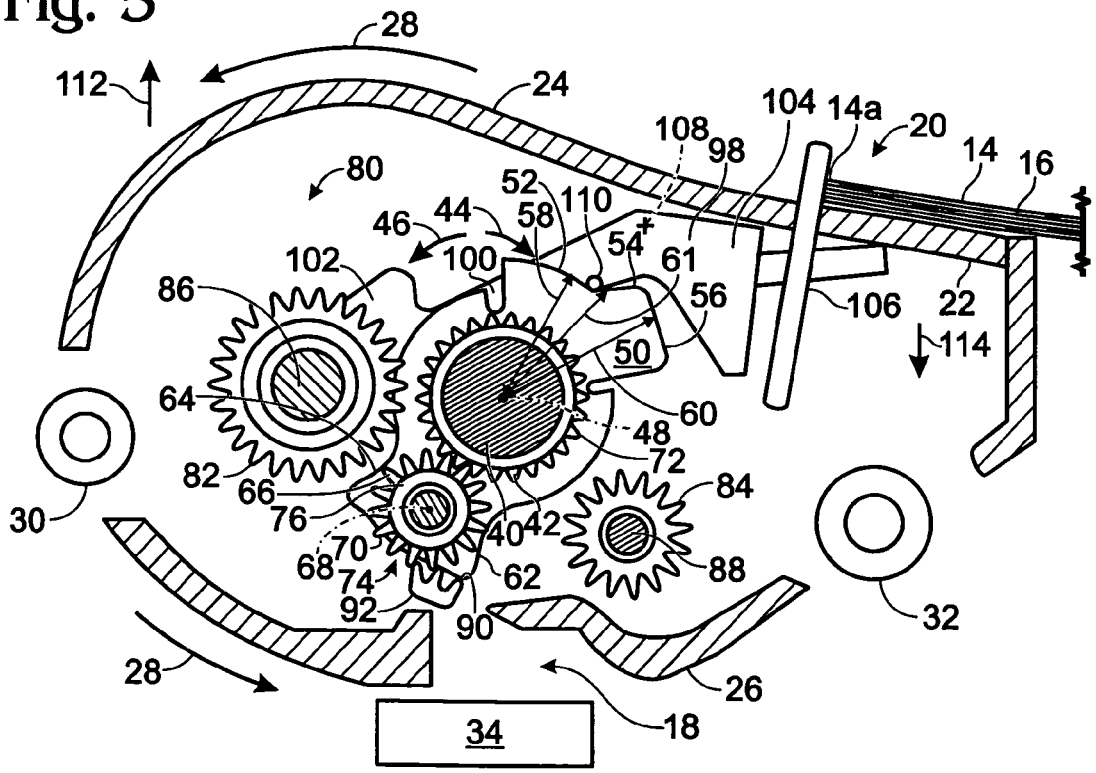
FIG. 5 is a side cross-sectional view of one embodiment of a rotating member disengaged from the scan mode.
Figure 6:
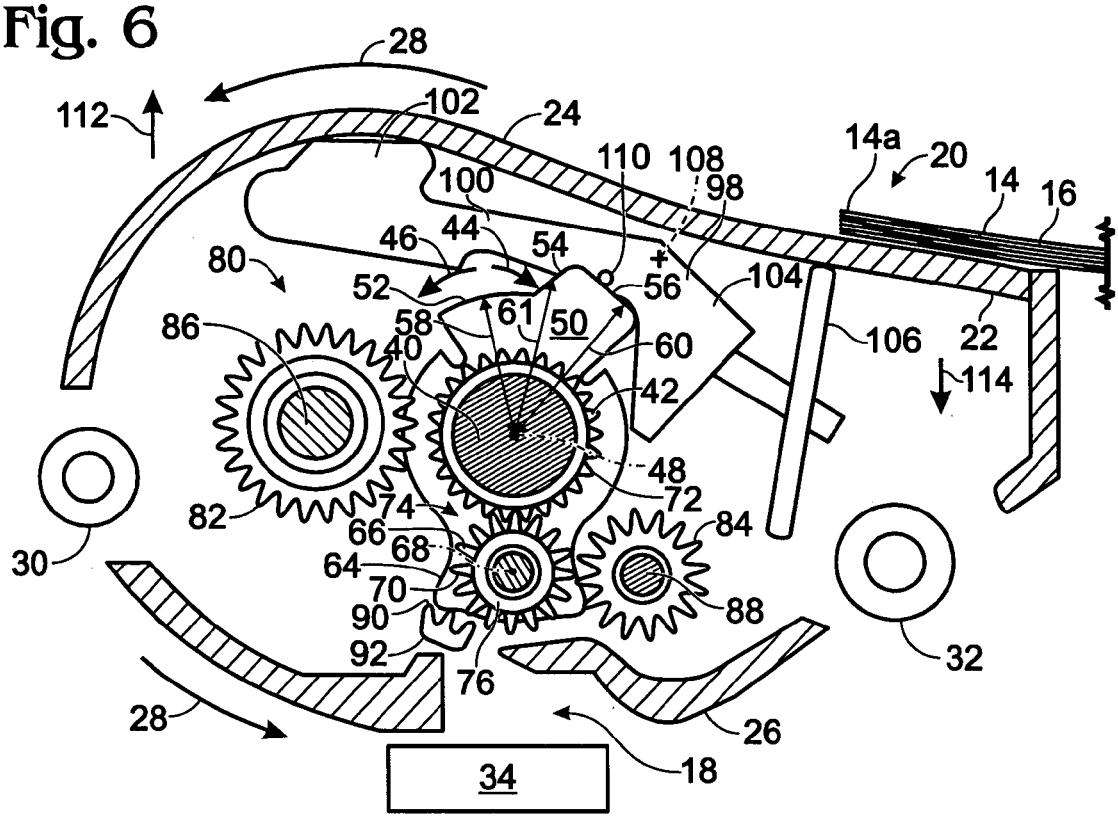
FIG. 6 is a side cross-sectional view of one embodiment of a rotating member in a gate actuation mode.
Figure 7:
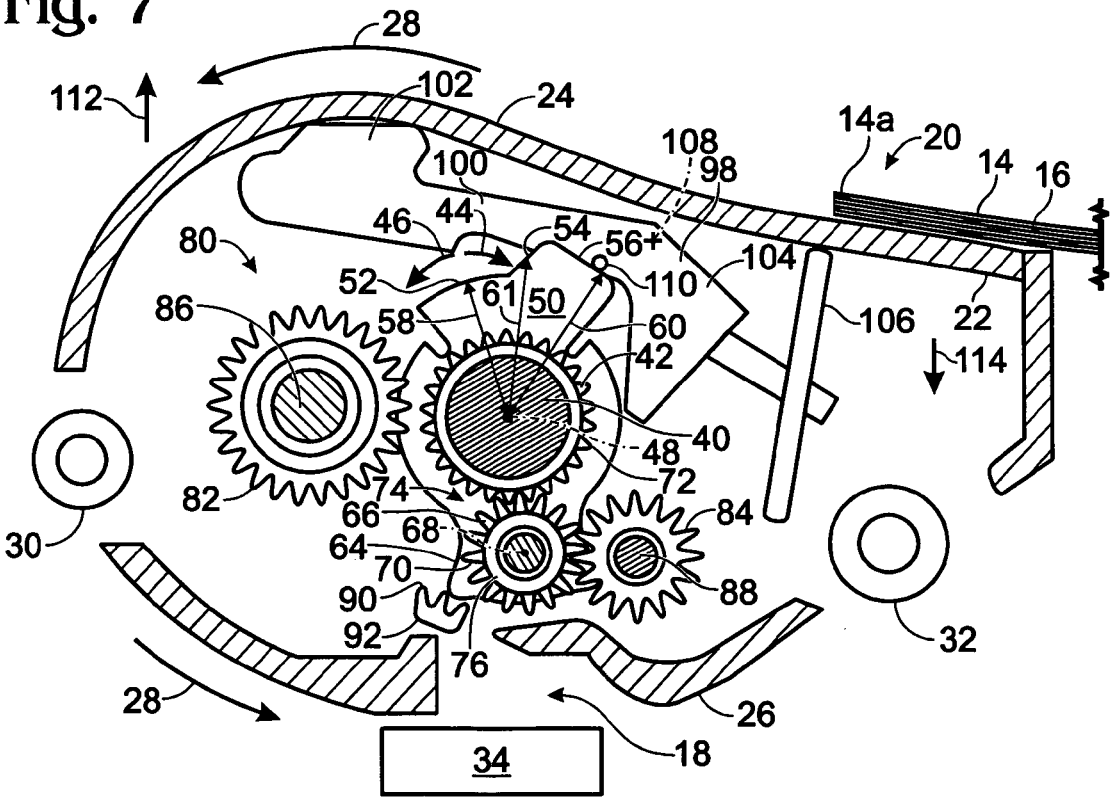
FIG. 7 is a side cross-sectional view of one embodiment of a rotating member in a pick mode.

Referring to FIGS. 5-7, when driveshaft 40 rotates in second direction 46, such as in a pick mode, i.e., when sheet 14 is picked from stack 16 for movement around chassis 22, drive gear 42 may also rotate in second direction 46, which may rotate gear 66 in first direction 44, which may rotate member 50 in second direction 46. Rotation of member 50 in second direction 46 may move gear 66 into engagement with second gear 84 and may cause rotation of second gear 84 in second direction 46. Stop surface 62 (see FIG. 2) on member 50 may contact a shaft 88 of second gear 84 and thereby may prevent over rotation of member 50 such that gear 66 does not overly engage second gear 84.

Referring again to FIGS. 5 and 6, mechanism 20 may further include stationary teeth 90, such as on a fixed or stationary rack gear 92, positioned to engage teeth 70 of gear 66 as gear 66 moves from engagement between first and second gears 82 and 84. During engagement between gear 66 and fixed gear 92, member 50 may be positively driven by rack gear 92 and, in the embodiment shown, member 50 may be driven at a 1:2 gear ratio, thereby doubling the torque of the member. In other words, as driveshaft 40 first begins to rotate in first direction 44, such as during initiation of a scan mode, i.e., when sheet 14 is moved around chassis 22 past imaging device 34, drive gear 42 may also rotate in first direction 44, which may rotate gear 66 in second direction 46. This may frictionally rotate member 50 in first direction 44 due to the connection of device 74 between gear 66 and member 50. Rotation of member 50 in first direction 44 may move gear 66 out of engagement with second gear 84, into engagement with fixed gear 92, and toward first gear 82. As gear 66 engages fixed gear 92, member 50 may not be merely frictionally driven by device 74 but may be positively driven by fixed gear 92.

Similarly, as driveshaft 40 first begins to rotate in second direction 46, such as during initiation of a pick mode, drive gear 42 may also rotate in second direction 46, which may rotate gear 66 in first direction 44. This may frictionally rotate member 50 in second direction 46 due to the connection of drag device 74 between gear 66 and member 50. Rotation of member 50 in second direction 46 may move gear 66 out of engagement with first gear 82, into engagement with fixed gear 92, and toward second gear 84. As gear 66 engages fixed gear 92, member 50 may not merely be frictionally driven by device 74 but may be positively driven by fixed gear 92.

Mechanism 20 may further include a gate actuator 98, such as a lever arm, including a first region 100 having a counterweight 102 positioned therein, a second region 104 having a gate 106 pivotally connected thereto, and a pivot axis 108 positioned therebetween. The pivotal connection of gate 106 on actuator 98 may allow gate 106 to retain a generally vertical orientation as actuator 98 pivots about pivot axis 108. Actuator 98 may further include a contacting surface 110, such as an outwardly extending post, which is positioned to move on first, second and third cam surfaces 52, 54 and 56, respectively, of member 50. Movement of actuator 98 along cam surfaces 52, 54 and 56 may be a rolling or a sliding movement, a combination thereof, or any other such movement. In particular, when gear 66 is engaged with first gear 82, contacting surface 110 of actuator 98 may be positioned on first cam surface 52 (see FIG. 2), which may allow counterweight 102 to pivot actuator 98 in second direction 46 about pivot axis 108, such that gate 106 may be in the raised or closed position (see FIGS. 2 and 5). In the raised or closed position, gate 106 may provide a stop surface for positioning of sheet 14 for picking by imaging system 10. This position of gate 106 may position a leading edge 14*a* of sheet 14 beyond a document flag (not shown) so that the imaging system may detect or sense that an original has been loaded in the ADF input tray. Gate 106 may also position leading edge 14*a* underneath a pre-pick roller (not shown) to facilitate a pre-pick roller (not shown) in correctly picking the sheet. Gate 106 may also function to stop printmedia stack 16 from being pushed between a nip (not shown) and a pick roller (not shown) so as to reduce the chance of an undesirable multi-sheet pick.

Referring to FIGS. 5 and 6, as gear 66 rotates in first direction 44 and member 50 rotates in second direction 46, such that gear 66 moves into engagement with fixed gear 92, contacting surface 110 of actuator 98 may move into contact with second cam surface 54 of member 50. Second cam surface 54 of actuator 98 may not be concentric with driveshaft axis 48 but instead may be a ramped surface. As gear 66 continues to rotate in first direction 44, gear 66 may fully engage fixed gear 92 as contacting surface 110 of actuator 98 may move upwardly along ramped or second cam surface 54. Gear 66 may fully engage fixed gear 92, therefore, when there is a load placed on member 50 by movement of contacting surface 110 upwardly along ramped cam surface 54. Accordingly, device 74 (see FIGS. 2 and 3) may be overridden by the positive engagement of gear 66 with fixed gear 92 during the critical high loading time period. Movement of contacting surface 110 upwardly along second cam surface 54 may move counterweight 102 upwardly in direction 112 and may move gate 106 downwardly in direction 114 and out of printmedia path 28. Accordingly, member 50 may be positively engaged to rotate about driveshaft axis 28 during the steepest, or transitional, phase of movement of contacting surface 110 along second cam surface 54, thereby reducing the chance that member 50 may stall or become stuck in neutral during movement of contacting surface 110 along ramped second cam surface 54.

Referring to FIG. 7, as gear 66 continues to rotate in first direction 44, and member 50 continues to rotate in second direction 46, gear 66 may engage second gear 84 and contacting surface 110 of actuator 98 may move into engagement with and along third cam surface 56. In this position, gate 106 maybe retained in the lowered or open position, outside of path 28, such that sheet 14 may be driven by drive rollers along path 28 for imaging thereon. As gear 66 is rotated in second direction 46, gear 66 may move into engagement with fixed gear 92 (see FIGS. 5 and 6) and into engagement with first gear 82 (see FIG. 2), and contacting surface 110 of actuator 98 may move along third cam surface 56, down second cam surface 54 and into engagement with first cam surface 52, thereby allowing counterweight 102 to move gate 106 upwardly into path 28. Accordingly, there is described a mechanism 20 that may operate to move drive rollers 30 and 32 in the forward direction when driveshaft 40 rotates in either of first or second directions 44 or 46, and which may also positively drive movement of a printmedia stop gate between a raised and a lowered position.

Figure 8:
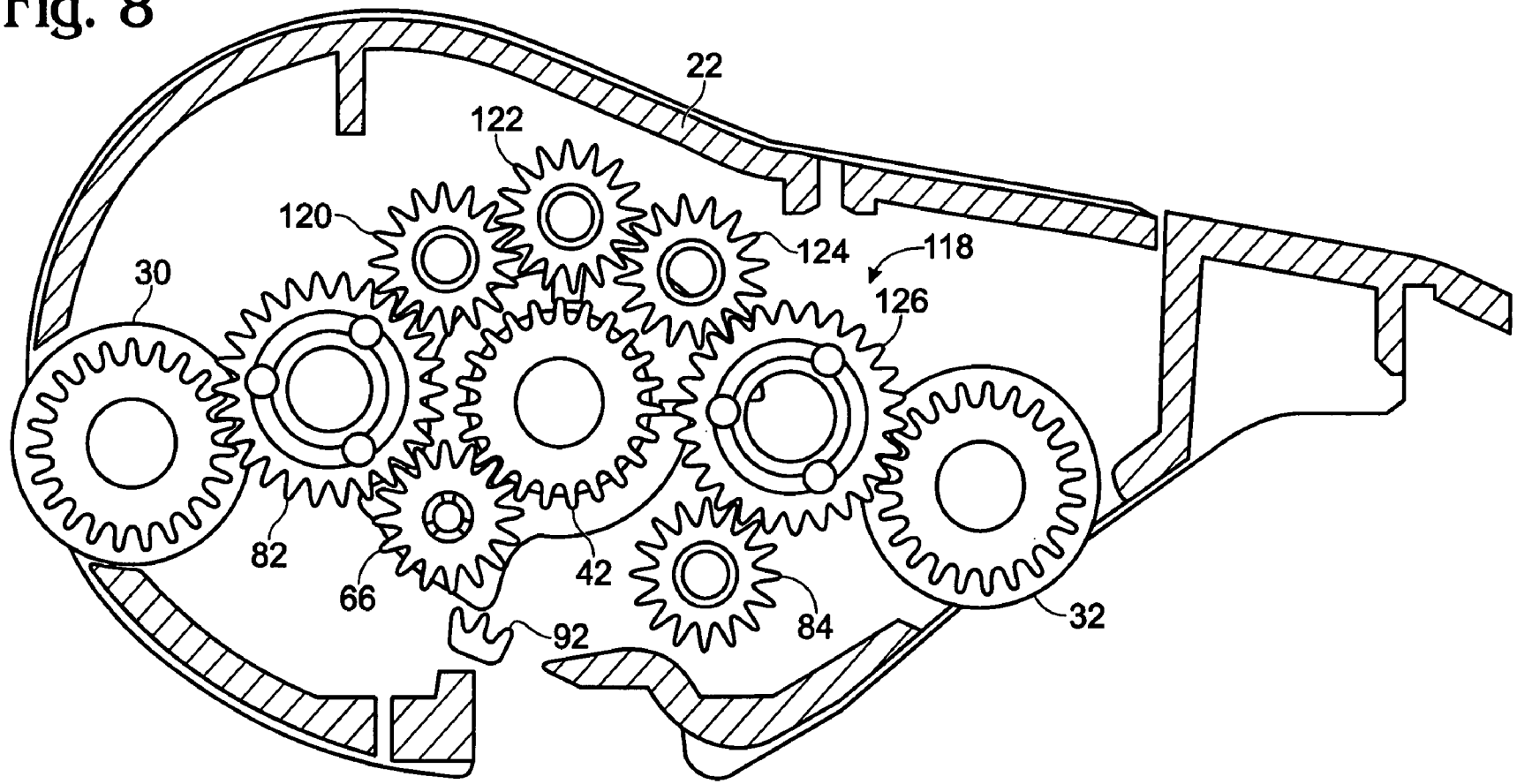
FIG. 8 is a side view of one embodiment of a gear train assembly.

FIG. 8 shows one embodiment of a gear train assembly 118 wherein gear 84 may be connected to roller 32 by an odd number of gears, namely, gear 126, and may be connected to roller 30 by an odd number of gears, namely, gears 126, 124, 122, 120 and 82. Gear 82 may be connected to roller 30 by an even number of gears, namely, by a direct connection, and may be connected to roller 32 by an even number of gears, namely, gears 120, 122, 124 and 126. Accordingly, rotation of gears 82 and 84 in opposite directions may result in rotation of rollers 30 and 32 in a single direction.

Other variations and modifications of the mechanism may be utilized wherein such variations and modifications of the concepts described herein fall within the scope of the claims below.

We claim:

1. A mechanism, comprising:

a member including a first axis and a surface non-concentric with said first axis;

a first gear rotatably mounted on said member at a second axis different from said first axis;

a device coupled to either of said member or said first gear to rotate said member about said first axis when said first gear rotates about said second axis;

a second gear; and a third gear, wherein movement of said member moves said first gear from engagement with said second gear and into engagement with said third gear, wherein said second gear is operatively connected to a drive roller through an odd number of gears and said third gear is operatively connected to said drive roller through an even number of gears such that rotation of said second gear in a first direction rotates said drive roller in said first direction, and wherein rotation of said third gear in a second, opposite direction rotates said drive roller in said first direction.

2. A mechanism according to claim 1 further comprising:

a drive shaft having a drive gear mounted thereon, wherein said member is rotatably mounted on said drive shaft about said first axis, and wherein said drive gear is rotated by said drive shaft and drivingly engages said first gear.

3. A mechanism according to claim 1 further comprising:

an actuator positioned to be selectively engaged by said surface; and a fourth gear positioned to engage said first gear when said surface engages said actuator.

4. A mechanism according to claim 1 further comprising:

a gate coupled to the surface, wherein said surface moves said gate between a first position and a second position while said first gear rotates.

5. A mechanism according to claim 4 further comprising:

a chassis that defines a media path, and wherein said gate in the first position is positioned within said media path and wherein said gate in the second position is positioned outside said media path.

6. A mechanism according to claim 1 wherein said second gear is operatively connected to a second drive roller through an odd number of gears and said third gear is operatively connected to said second drive roller through an even number of gears such that rotation of said second gear in said first direction rotates said second drive roller in said first direction and rotation of said third gear in said second, opposite direction rotates said second drive roller in said first direction.

7. A mechanism, comprising:

a member rotatably mounted about a first axis;

a first gear rotatably mounted on said member about a second axis different from said first axis;

a device coupled to one of said member and said first gear to rotate said member about said first axis when said first gear rotates about said second axis;

a second gear; and a third gear, wherein rotation of said member moves said first gear between engagement with said second gear and said third gear, wherein said second gear is operatively connected to a roller such that rotation of said second gear in a first direction rotates said roller in said first direction, and wherein said third gear is operatively connected to said roller such that rotation of said third gear in a second, opposite direction rotates said roller in said first direction.

8. A mechanism according to claim 7 wherein said second gear is operatively connected to a second roller such that rotation of said second gear in said first direction rotates said second roller in said first direction, and wherein said third gear is operatively connected to said second roller such that rotation of said third gear in said second, opposite direction rotates said second roller in said first direction.

9. A mechanism according to claim 7 wherein said device is a drag device such that rotation of said first gear in one direction about said second axis rotates said member in an opposite direction about said first axis.

10. A mechanism according to claim 7 further comprising:

a fourth gear positioned to engage said first gear as said first gear moves between engagement with said second gear and said third gear, wherein said member rotates about said first axis as said first gear engages said fourth gear.

11. A mechanism according to claim 10 wherein said fourth gear is a fixed gear.

12. A mechanism according to claim 7 further comprising:

a drive shaft having a drive gear mounted thereon, wherein said member is rotatably mounted on said drive shaft about said first axis, and wherein said drive gear is rotated by said drive shaft and drivingly engages said first gear.

13. A mechanism according to claim 7 wherein said member includes a first cam surface non-concentric with said first axis and at least one second cam surface concentric with said first axis, wherein said at least one second cam surface communicates with said first cain surface.

14. A mechanism according to claim 13 further comprising:

an actuator positioned to move along said first cam surface and said at least one second cam surface when said member rotates about said first axis; and a gate connected to the actuator, wherein said actuator moves said gate between a first position and a second position while said member rotates.

15. A mechanism according to claim 14 further comprising:

a chassis defining a media path, wherein said gate in the first position is positioned within said media path and said gate in the second position is positioned outside said media path.

* * * * *

UNITED STATES PATENT AND TRADEMARK OFFICE

CERTIFICATE OF CORRECTION

PATENT NO. : 7,251,449 B2
APPLICATION NO. : 10/859275
DATED : July 31, 2007
INVENTOR(S) : Kevin Bokelman et al.

It is certified that error appears in the above-identified patent and that said Letters Patent is hereby corrected as shown below:

In column 6, line 67, in Claim 13, delete “cain” and insert -- cam --, therefor.

Signed and Sealed this

Twelfth Day of August, 2008

JON W. DUDAS
*Director of the United States Patent and Trademark Office*